US011389817B2

(12) United States Patent
Hunter et al.

(10) Patent No.: US 11,389,817 B2
(45) Date of Patent: Jul. 19, 2022

(54) EPOXY COATING SYSTEM AND PROCESS FOR CYLINDRICAL ITEMS

(71) Applicants: Robert Hunter, Port Richey, FL (US); John Reinhard, New Port Richey, FL (US)

(72) Inventors: Robert Hunter, Port Richey, FL (US); John Reinhard, New Port Richey, FL (US)

( * ) Notice: Subject to any disclaimer, the term of this patent is extended or adjusted under 35 U.S.C. 154(b) by 76 days.

(21) Appl. No.: 16/535,249

(22) Filed: Aug. 8, 2019

(65) Prior Publication Data

US 2020/0047212 A1 Feb. 13, 2020

Related U.S. Application Data

(60) Provisional application No. 62/715,880, filed on Aug. 8, 2018.

(51) Int. Cl.

| | |
|---|---|
| ***B05D 3/12*** | (2006.01) |
| ***B05C 1/02*** | (2006.01) |
| ***B05D 1/28*** | (2006.01) |

(52) U.S. Cl.

CPC ..... *B05C 1/022* (2013.01); *B05D 1/28* (2013.01); *B05D 3/12* (2013.01)

(58) Field of Classification Search

CPC ..... B05C 1/022; B05C 13/025; B05D 3/12; B05D 1/28; B05D 2504/00; B05D 1/002

See application file for complete search history.

(56) References Cited

U.S. PATENT DOCUMENTS

| | | | | |
|---|---|---|---|---|
| 4,229,014 A * | 10/1980 | Crowe | B23B 31/30 | 279/66 |
| 4,642,248 A * | 2/1987 | Howland | B29C 35/04 | 118/107 |
| 4,794,680 A * | 1/1989 | Meyerhoff | D02G 1/12 | 219/121.72 |
| 5,688,552 A * | 11/1997 | Lacomis | B41F 13/08 | 427/140 |
| 2001/0023513 A1* | 9/2001 | Monteiro | D06F 21/04 | 8/158 |
| 2008/0102967 A1* | 5/2008 | Gleasman | F16D 3/16 | 464/145 |

* cited by examiner

*Primary Examiner* — Hai Y Zhang

(74) *Attorney, Agent, or Firm* — Larson & Larson, P.A.; Justin P. Miller; Frank Liebenow

(57) ABSTRACT

An epoxy coating can be applied to a round surface by keeping the round surface in constant motion, thus defeating the tendency of the epoxy to run off the outer surface of the round object. The process is aided by mechanical equipment that rotates the cylindrical object about its center, while also permitting adjustment of rotational speed.

16 Claims, 13 Drawing Sheets
(2 of 13 Drawing Sheet(s) Filed in Color)

EPOXY COATING SYSTEM AND PROCESS FOR CYLINDRICAL ITEMS

CROSS-REFERENCE TO RELATED APPLICATION

This application is a continuation-in-part of U.S. Pat. App. Ser. No. 62/715,880, filed Aug. 8, 2018, titled Method And Apparatus To Finish Cylindrical Articles.

FIELD

This invention relates to the field of epoxy coating and more particularly to a system and method for epoxy coating cylindrical items.

BACKGROUND

Epoxy coatings are useful for both protective and decorative purposes. Epoxy creates a tough and chemical-resistant surface, while strengthening the underlying structure. In the hands of an artist, the coating can also be attractive with a mix of color and patterns.

But to create artistic coatings, the epoxy must be applied in a layer thicker than a film, creating the problem of movement. Epoxy is self-leveling, which is a benefit when applied to flat surfaces. But when applied to a sloped or rounded object, the epoxy runs off the surface. Thus, round articles cannot be coated in the protective and artistic way that flat surfaces can.

What is needed is a system and method for coating round objects with epoxy.

SUMMARY

An epoxy coating can be applied to a round surface by keeping the round surface in constant motion, thus defeating the tendency of the epoxy to run off the outer surface of the round object.

The process is aided by mechanical equipment that rotates the cylindrical object or item about its center, along an axis, while also permitting adjustment of rotational speed.

An explanation of epoxy is helpful.

Epoxy is the result of a mix of resin and hardener in a specific ratio. The ration varies by manufacturer. For example, Uvpoxy by EcoPoxy uses a ratio of 1:1. Epoxy from Total Boat Resin uses a ratio of 2:1. Total Boat also has the option of Fast, Medium, and Slow hardeners which may cause a user to choose it as the preferred epoxy.

Once mixed, a chemical reaction begins and the mixture begins to stiffen. Thus, timing and order of operations are each important.

The process is summarized as:

Mix—the components are mixed;

Work—the mixture is applied and manipulated until it begins to set;

Set—the mixture is too stiff to manipulate further;

Full dry—the mixture is dry to the touch; and

Full cure—the process of setting is complete.

When the mixture changes from a liquid to a gel, it can no longer be manipulated, thus working time ends.

Sample times are included in the following table. "TB" is an abbreviation for the manufacturer Total Boat:

| | Mix | Work | Set | Full Dry | Cured |
|---|---|---|---|---|---|
| TB Fast | Varies | 10 min | 30 min | 120 min | 48 hour |
| TB Medium | Varies | 25 min | 60 min | 180 min | 84 hour |
| TB Slow | Varies | 40 min | 150 min | 300 min | 5 day |
| Art Resin | Varies | 40 min | 4-5 hours | 8 hrs | 72 hours |
| Ecopoxy | Varies | 40 min | 2-3 hours | 4-6 hours | 72 hours |

Next, discussion turns to the mechanical components that allow a user to execute the method.

The primary component is a motor with optional gearbox that rotates an axle, the axle in turn rotating an internal support that interfaces with the cylindrical object. The motor optionally includes variable speed and reversible direction. As a further option, the motor may use a controller to automatically reverse the direction of rotation following a certain number of rotations. For example, five rotations clockwise, then five rotations counter-clockwise, then five rotations clockwise, and so forth.

The motor and gearbox must generate sufficient torque to rotate an out-of-balance object because during application of the epoxy mixture sections of the cylindrical object will have excess epoxy. This excess epoxy will weigh down the associated section, thus resisting rotation. The motor and gearbox must overcome this opposing torque to maintain rotational speed. Insufficient torque will result in surging, or inconsistent rotational speed.

The axle is supported on each end by bearings or blocks. The axle defines the axis of rotation.

Optionally, additional axles are used to rotate additional objects. This allows the user to coat multiple objects in a similar manner, thus creating matching items.

The internal support, bridging the space between the axle and the cylindrical object, can take multiple forms.

A first form is an inflatable bladder. The inflatable bladder is inflated using air passed through a hollow axle, exiting the axle into the center of the bladder.

Inflation of the bladder presses the outer surface of the bladder against the inner surface of the cylindrical article, creating a mechanical connection.

A second form of internal support is expanding arms. The arms are rotationally fixed with respect to the axle, with feet that can move outward to press against the interior surface of the cylindrical article.

A third form of internal support is a spoked wheel, or other type of disk. This support is most useful for objects that have a narrow band of internal surface, and thus are difficult to hold with the methods described above. For example, a ring of material.

A fourth form of support is an external support, used for solid objects such as drumsticks. The drumstick is inserted into a chuck, which grips a section of its outer surface using a foam or other deformable material.

A fifth form of support is similar to that used for a wood-working lathe, with an adjustable chuck at one end and pointed axle/tail-stock at the opposing end.

Using the above mechanism, the process is as follows:

First, the cylindrical object is mounted in place using a support affixed to the axle.

Next, the cylindrical object is optionally coated with a tinted quick-dry resin to prepare the surface. The use of a quick-dry resin is most critical for porous surfaces.

The quick-dry resin is preferably an epoxy with a fast-set time to reduce the opportunity for the introduction of air bubbles. Application may be by brush or spray.

Once dry, the quick-dry resin is sanded to even out any raised grain that may have been created by absorption of the quick-dry resin.

Next, an optional background coat is applied. Note that this is the first layer of material, and thus the lowest layer of the final product. The background may include the addition of particulates, such as glitter.

Next, epoxy application then begins.

For each layer, the user chooses between a fast or slow setting epoxy.

Fast-setting epoxies are preferred for elements of the image that are smaller or defined by a single color. For example, a beach or a sky. The faster set is preferred to minimize mixing with subsequent layers and reduce the wait time for application of subsequent layers.

Slow-setting epoxies are preferred for broad scenes that may use multiple epoxies that are mixed during and after application. The slower setting time allows the user greater flexibility to manipulate the epoxy. Slow-setting epoxy is also preferred if a thinning color additive is used because some additives will thin the epoxy mixture and increase the set time, but others will thicken and decrease the set time. A slow-setting epoxy is more tolerant of these changes because the slower set time allows heat to leave the epoxy mixture gradually, no matter how the tint affects the behavior of the epoxy.

Having chosen the desired epoxy, the user mixes the resin and hardener. The user optionally mixes in solids, such as glitter, golf leaf, pearl, or powders. The user may also optionally mix in liquids, such as alcohol-based tints, or paint.

Next, rotation is started of the cylindrical object.

The user then begins to apply the epoxy mixture. The epoxy mixture is poured onto the rotation surface of the cylindrical object, where it is then manipulated.

Manipulation can take the form of direct contact from a finger, brush, or stick, or indirect contact using hot air—which thins the epoxy—or air from a compressor or blown through a straw.

Manipulation can continue until the epoxy sets, at which time it is too thick to be readily manipulated.

The user can then begin preparation of the next layer, repeating the steps of choosing an epoxy, mixing, and applying while the underlying layer continues to harden until fully cured.

When the user has completed application of epoxy, the cylindrical object is allowed to continue to rotate until fully set, although not yet dry. This step is estimated to require between six and eight hours.

After the underlying epoxy is dry, a protective coating of clear epoxy is applied. The protective coating is applied using a notched trowel to ensure the correct thickness. If too little is applied, crater or depressions will form. If too much is applied, ridges and bulges will form.

This protective layer is then allowed to dry.

Epoxy creates heat during the chemical process of curing. To take advantage of this property, a temperature sensor is optionally used to monitor the temperature of the curing epoxy. When a low temperature is detected, rotation is stopped.

The benefit of epoxy application is not only artistic, but also mechanical. For example, when drums, such as those used for music, receive an epoxy coating the result is a drum with increased resonance and a decreased delay between a hit and the drum reaching its final pitch.

Coated drum sticks are softer and more-comfortable to grip than uncoated sticks. Additionally, as a user holds the drum sticks, the body heat of the user warms the epoxy coating, making it tacky and more easily gripped by the user.

Discussion now turns to a detailed description of an embodiment.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The invention can be best understood by those having ordinary skill in the art by reference to the following detailed description when considered in conjunction with the accompanying drawings in which.

DETAILED DESCRIPTION

Figure 1B:
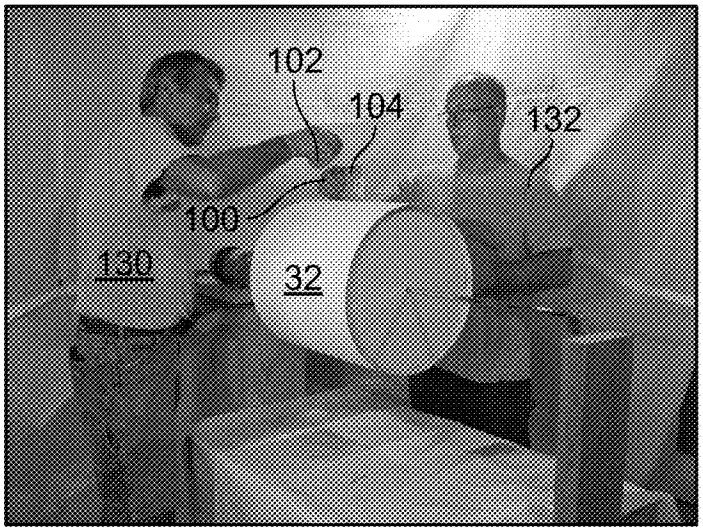
FIG. 1B illustrates a second step of the epoxy coating method.

Reference will now be made in detail to the presently preferred embodiments of the invention, examples of which are illustrated in the accompanying drawings. Throughout the following detailed description, the same reference numerals refer to the same elements in all figures.

Figure 1A:
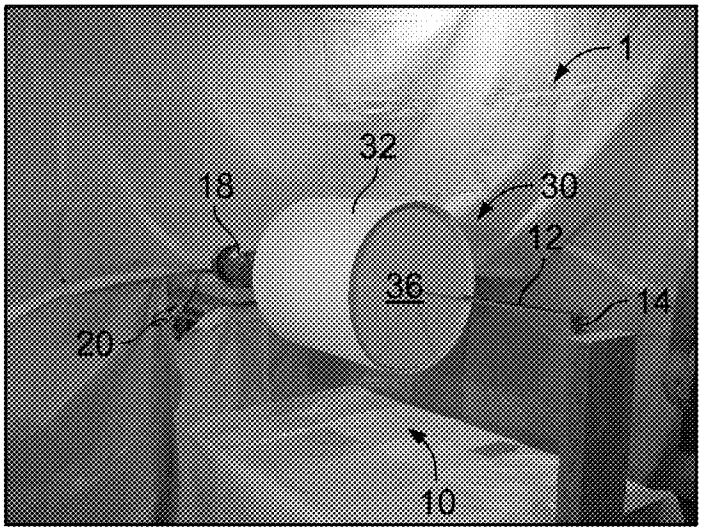
FIG. 1A illustrates a first step of the epoxy coating method.

Referring to FIG. 1A, a first step of the epoxy coating method is shown.

The epoxy coating apparatus 1 is shown before any epoxy has been added.

The rotation apparatus 10 includes axle 12, the free end of which rotates on, or within, a block 14.

The opposite end of the axle 12 connects to the motor 18 with optional rotational speed and direction controls 20.

A cylindrical item 30 is held using an internal support 36 that bridges the distance between the axle 12 and the cylindrical item 30.

Referring to FIG. 1B, a second step of the epoxy coating method is shown.

User one 130 is applying epoxy mixture 100 by pouring from an epoxy container 102. User two 132 is using a notched trowel 104 to spread the epoxy mixture 100 while maintaining a constant thickness.

On a flat, horizontal surface, the epoxy resin can be allowed to sit and self-level, creating an even thickness. But on the rotating surface of the cylindrical object 32, a notched trowel helps to ensure even application.

Figure 1D:
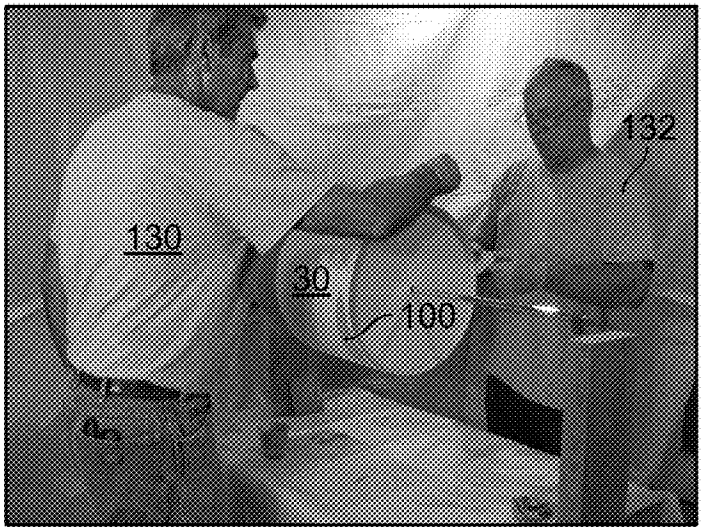
FIG. 1D illustrates a fourth step of the epoxy coating method.
Figure 1C:
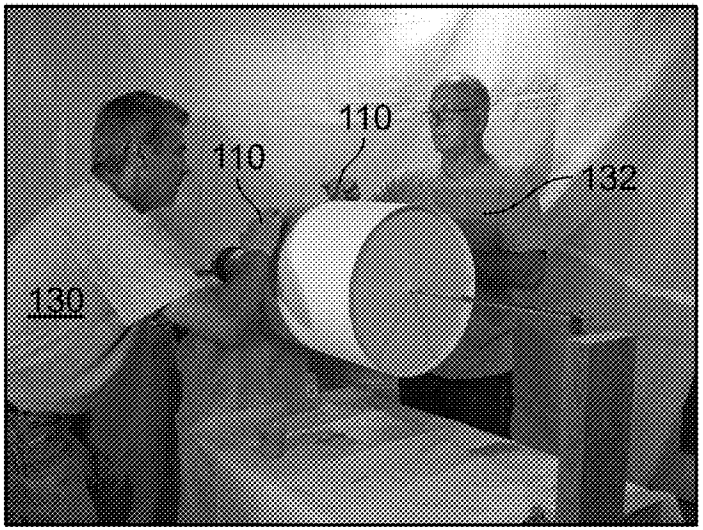
FIG. 1C illustrates a third step of the epoxy coating method.

Referring to FIG. 1C, a third step of the epoxy coating method is shown.

User one 130 and user two 132 are removing any lines left by the notched trowel 104 (See FIG. 1B) using gloves 110.

Referring to FIG. 1D, a fourth step of the epoxy coating method is shown.

A new section of epoxy mixture 100 is being applied in a different section of the cylindrical item 30.

Figure 1F:
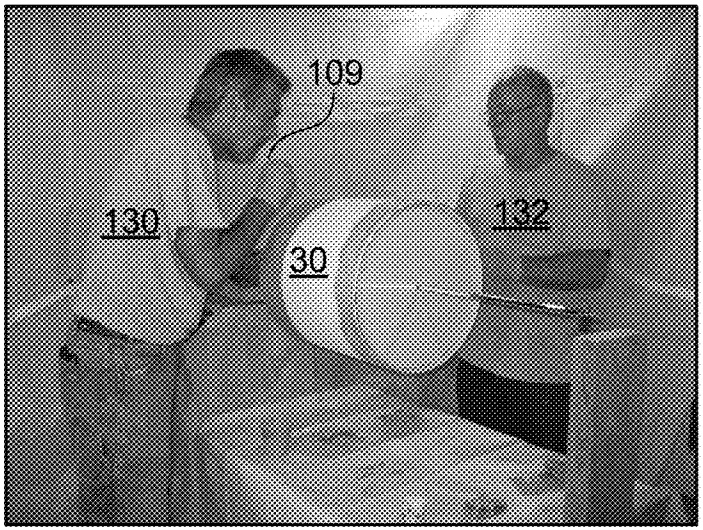
FIG. 1F illustrates a sixth step of the epoxy coating method.
Figure 1E:
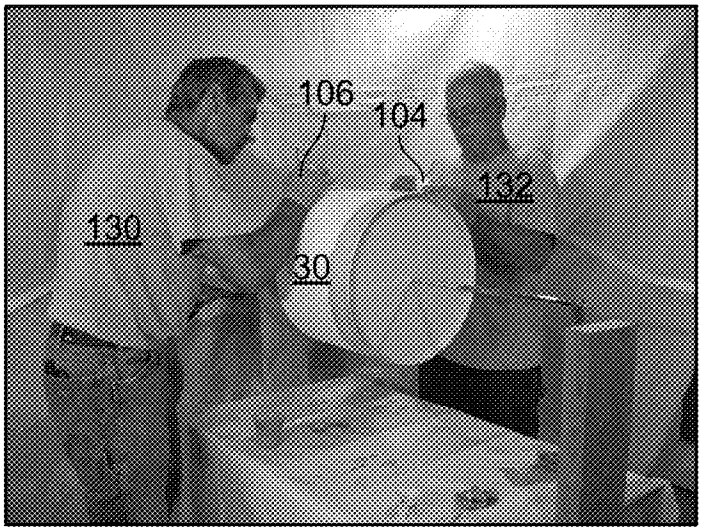
FIG. 1E illustrates a fifth step of the epoxy coating method.

Referring to FIG. 1E, a fifth step of the epoxy coating method is shown.

User one 130 is using a brush 106 to add on isolated items, such as images of clouds. User two 132 is using a notched trowel 104 to even out the section of epoxy mixture 100 applied in the previous step.

Referring to FIG. 1F, a sixth step of the epoxy coating method is shown.

User one 130 is using a straw 108 to blow across the epoxy mixture 100, spreading and creating effects.

Figure 1H:
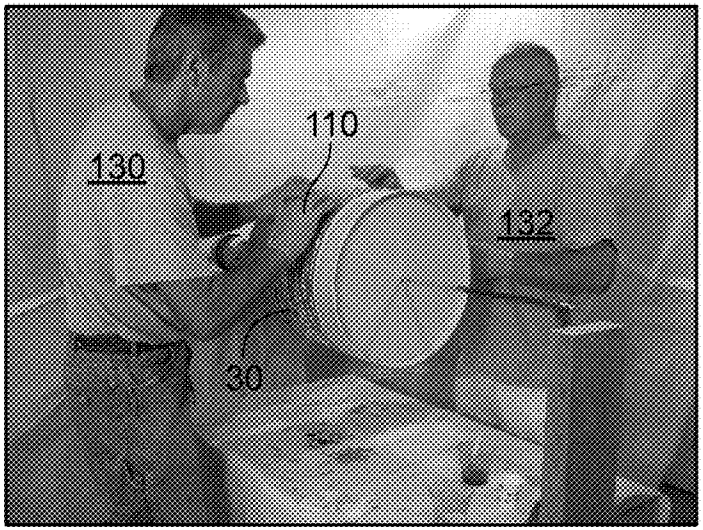
FIG. 1H illustrates an eighth step of the epoxy coating method.
Figure 1G:
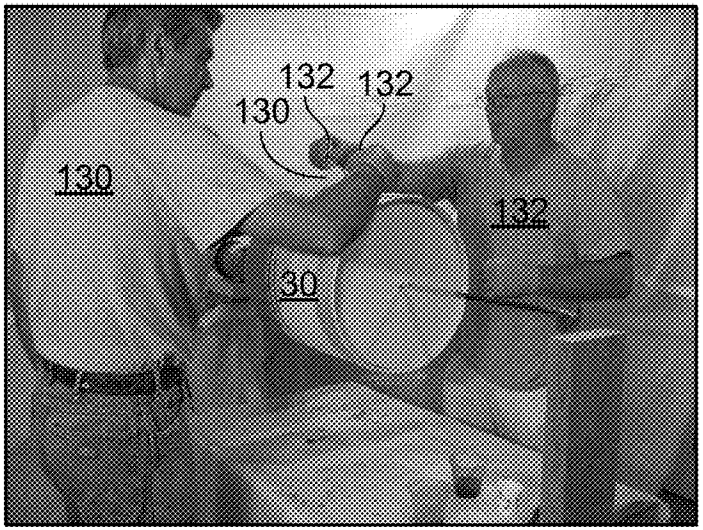
FIG. 1G illustrates a seventh step of the epoxy coating method.

Referring to FIG. 1G, a seventh step of the epoxy coating method is shown.

User one 130 and user two 132 are each applying epoxy mixture 100 using an epoxy container 102

Referring to FIG. 1H, an eighth step of the epoxy coating method is shown.

User one 130 is blending the two epoxy resins 100 applied in the previous step, using gloves 110.

Figure 1J:
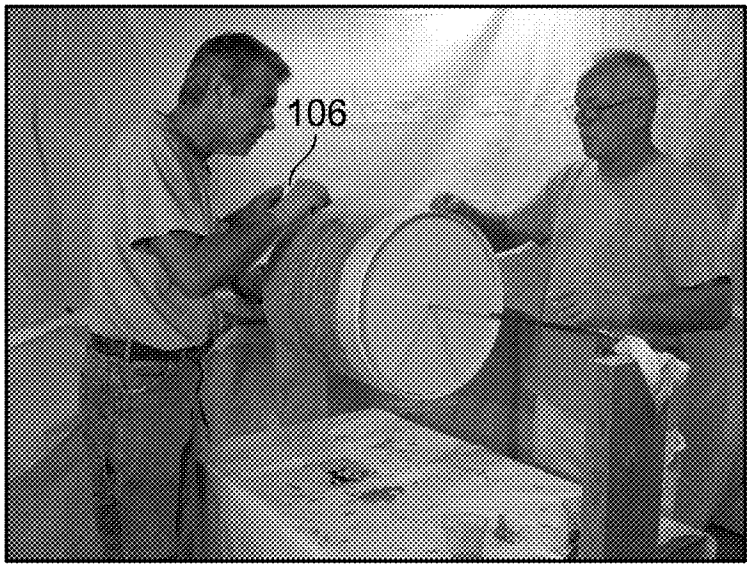
FIG. 1J illustrates a tenth step of the epoxy coating method.
Figure 1I:
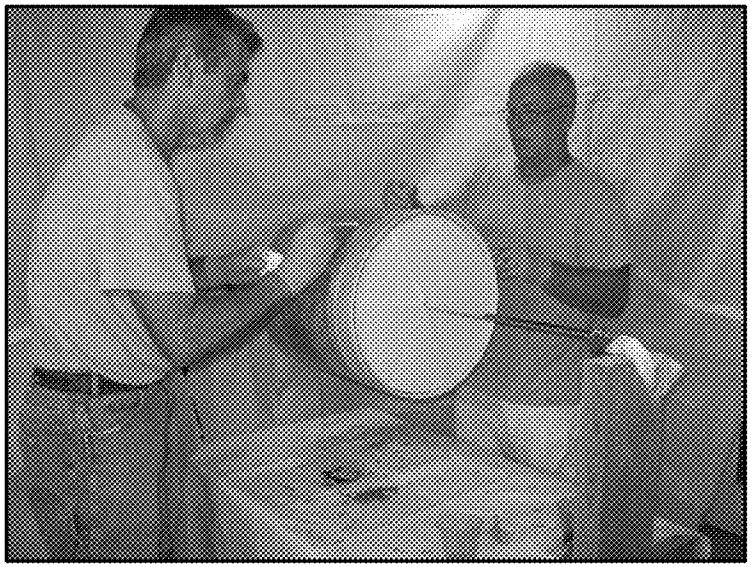
FIG. 1I illustrates a ninth step of the epoxy coating method.

Referring to FIG. 1I, a ninth step of the epoxy coating method is shown.

User one 130 and user two 132 are applying small amounts of epoxy mixture 100 using sticks 112.

Referring to FIG. 1J, a tenth step of the epoxy coating method is shown.

User one 130 is applying final touches using a brush 106.

The cylindrical item 30 is then allowed to rotate until the epoxy resin has fully set.

Figure 2:
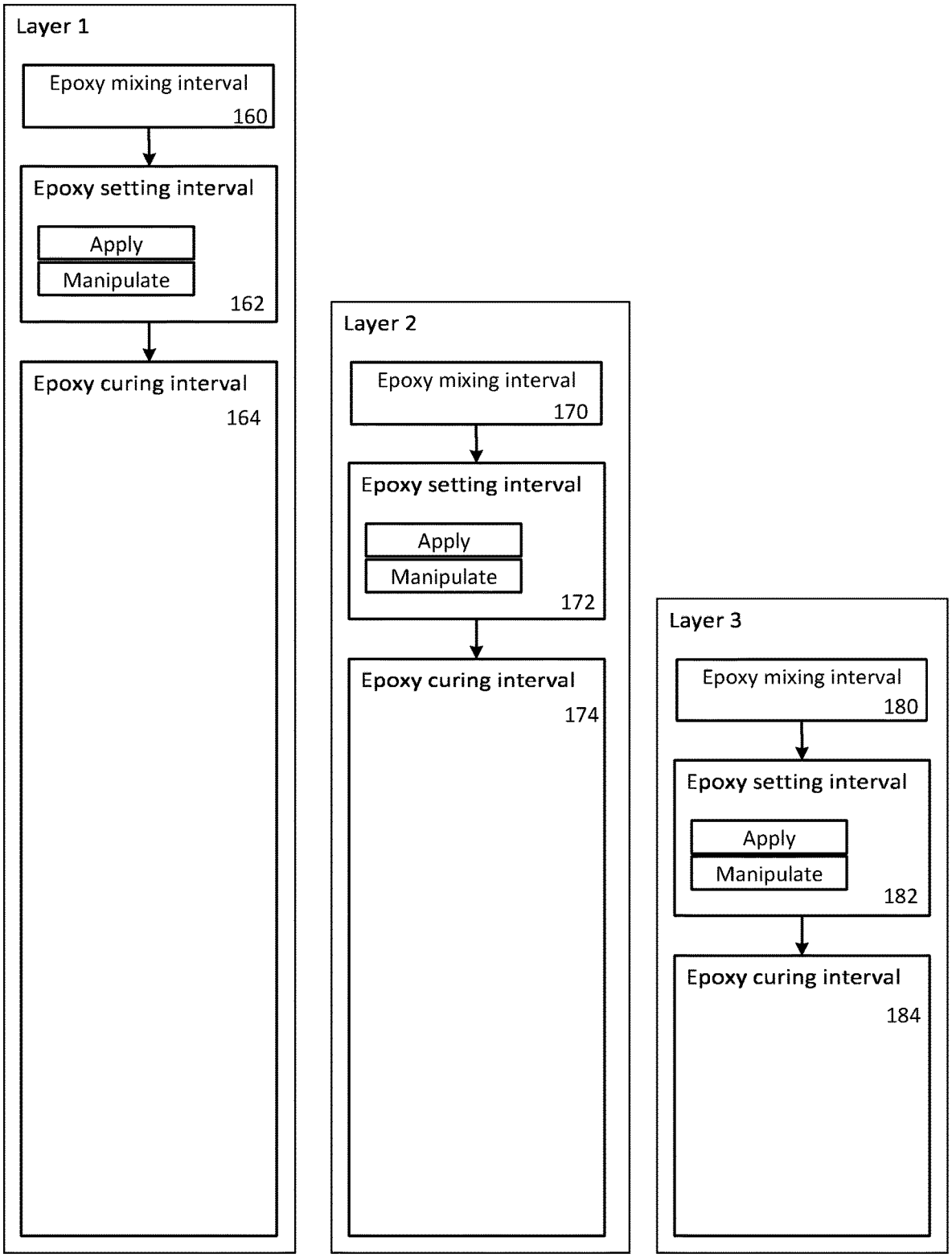
FIG. 2 illustrates a flow chart of the epoxy coating method.

Referring to FIG. 2, a flow chart of the epoxy coating method is shown.

Application of layers of epoxy resin is a progressive process, in particular for layer that the user does not want to mix. For example, a lower layer of dark epoxy and an upper layer of lighter epoxy resin that, if mixed, would lose their contrast.

The application of layer 1, the first and lowest layer, starts with the layer 1 epoxy mixing interval 160.

Then begins the layer 1 epoxy setting interval 162, during which the epoxy resin is in liquid form and ready to apply and be manipulated. This interval ends when the epoxy has cured to stage where the epoxy is too thick to manipulate.

The epoxy is then allowed to partially cure during the layer 1 epoxy curing interval 164.

With layer 1 partially cured, a second layer can be mixed and applied. Thus, layer 2 passes through the layer 2 epoxy mixing interval 170, layer 2 epoxy setting interval 172, and layer 2 epoxy curing interval 174.

Then, with layer 2 partially cured, layer 3 passes through the layer 3 epoxy mixing interval 180, layer 3 epoxy setting interval 182, and layer 3 epoxy curing interval 184.

Figure 3:
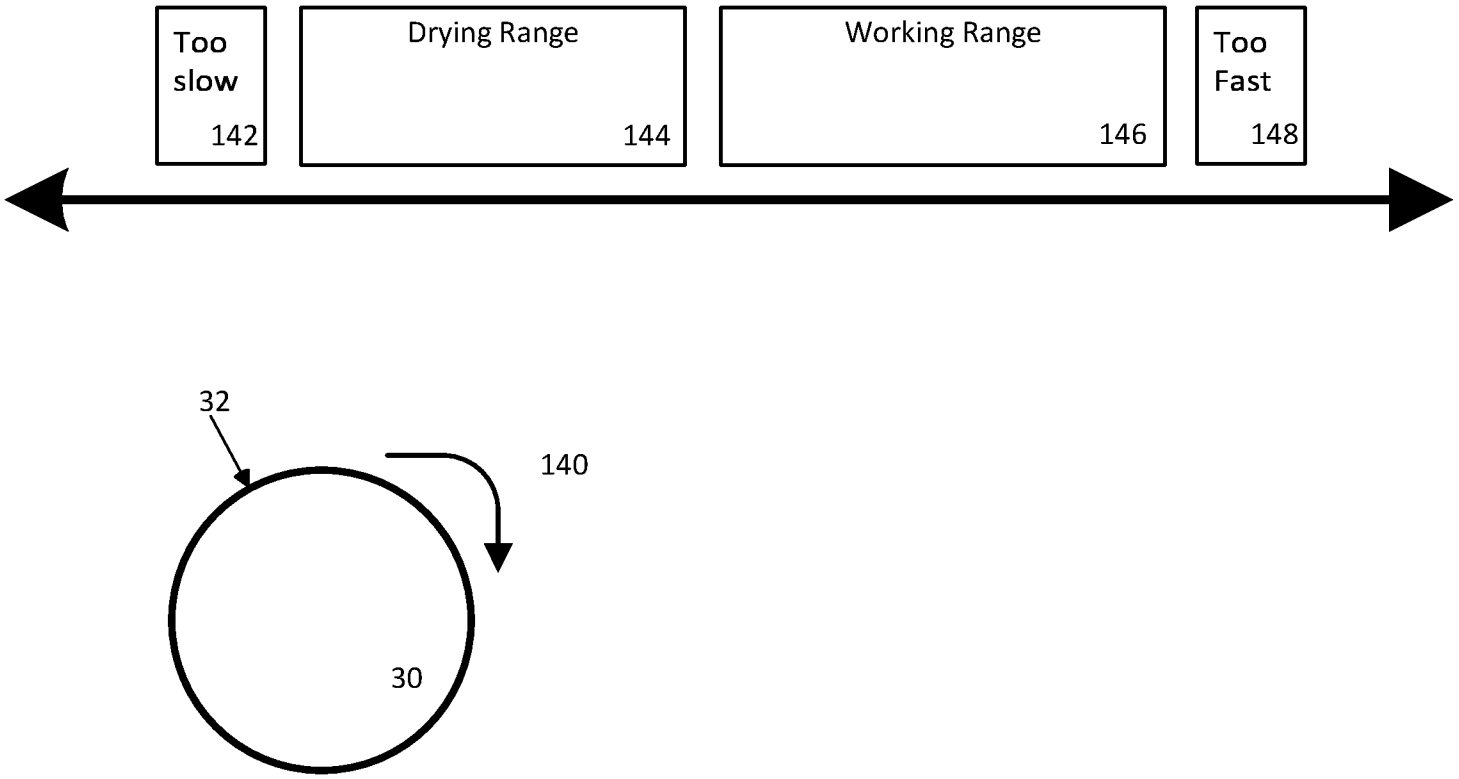
FIG. 3 illustrates a rotational speed chart of the epoxy coating method.

Referring to FIG. 3, a rotational speed chart of the epoxy coating method is shown.

The cylindrical item 30 rotates 140 during application of the epoxy mixture 100. An appropriate speed of rotation is important to ensure the epoxy mixture 100 dries evenly, but also is not ejected off the surface of the cylindrical item 30.

If the speed is an excessive rotation speed 148, a wet epoxy mixture 100 will be ejected off the outer surface 32 of the cylindrical item 30.

The working range rotation speed 146 of between two and four RPM (Revolutions Per Minute) is the ideal range for an epoxy mixture 100 during application. The speed is then increased to between five and ten RPM for between one and four minutes to allow the epoxy mixture 100 to level without falling off the cylindrical item 30.

When the epoxy mixture 100 has moved from the setting interval 162 to the curing interval 164 (see FIG. 2), the speed can be reduced to the curing range rotation speed 144 of between one and two RPM.

Rotation 140 must be maintained at a high enough speed to ensure consistent thickness of the epoxy mixture 100. If the rotation speed drops to an insufficient rotation speed 142, a wet epoxy mixture 100 will fall off the surface, and a partially cured resin will cure in inconsistent thickness.

Figure 4:
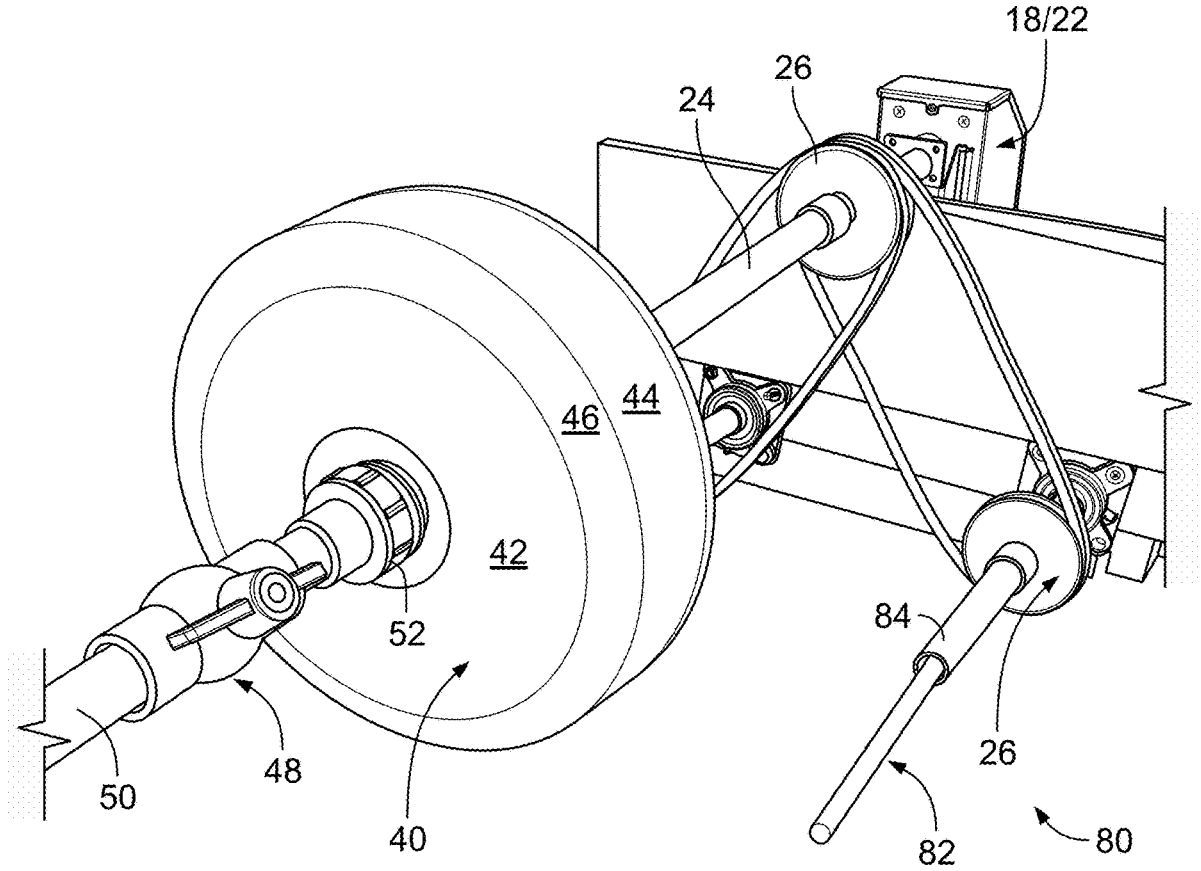
FIG. 4 illustrates a first view of the epoxy coating apparatus.

Referring to FIG. 4, a first view of the epoxy coating apparatus is shown.

The rotation apparatus 10 is shown with bladder 40. The bladder 40 includes an end surface 42, a perimeter surface 44, connected by a transition 46.

An air valve 48 is used to inflate the bladder 40. Air is preferably provided to the air valve 48 through a drive shaft with internal air passage 50.

A bladder coupler 52 connects the air valve 48 to the bladder 40.

Also shown is a location for secondary item rotation 80, shown with a drumstick 82 inserted into a chuck 84. By rotating two items together, epoxy mixture 100 may be mixed and applied to the items simultaneously, ensure that the items match each other.

The secondary item rotation 80 and drive axle 24 are connected by pulleys 26 and belts 28.

A motor 18 with optional gearbox 22 rotates the drive axle 24.

Figure 5:
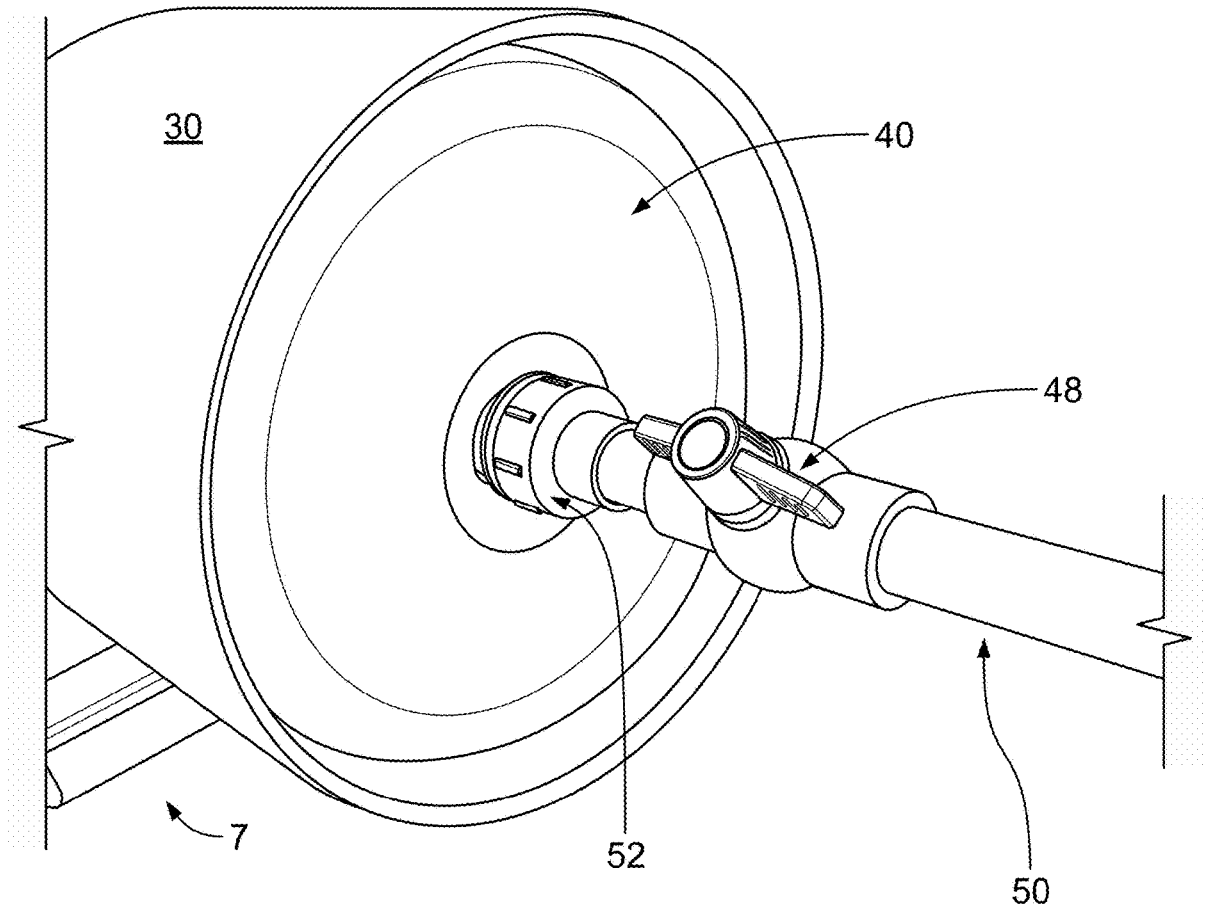
FIG. 5 illustrates a second view of the epoxy coating apparatus.

Referring to FIG. 5, a second view of the epoxy coating apparatus is shown.

A cylindrical item 30 is mounted on bladder 40. Again shown are air valve 48, drive shaft with internal air passage 50, and bladder coupler 52.

Figure 6:
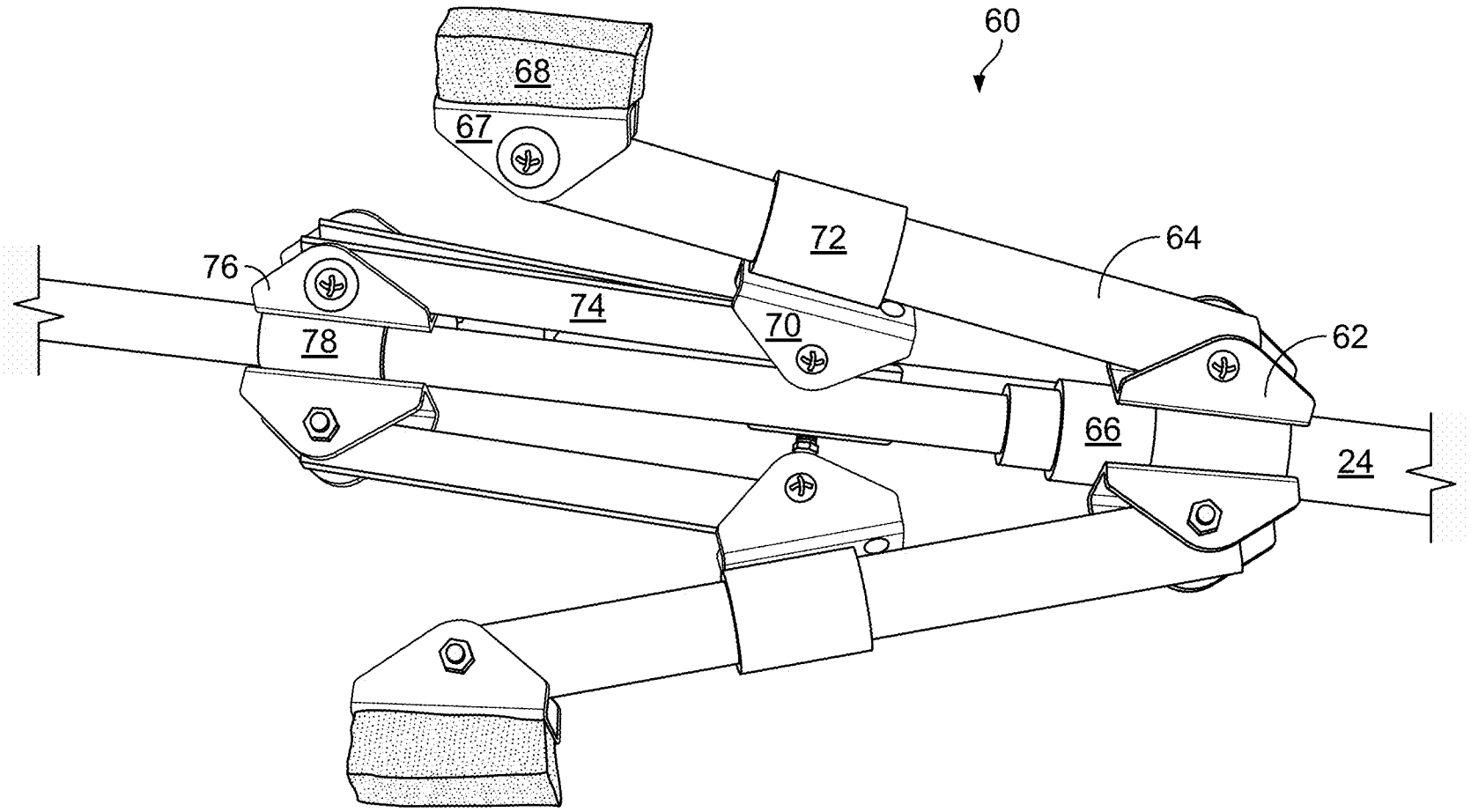
FIG. 6 illustrates a first view of adjustable stabilizing legs of the epoxy coating apparatus.
Figure 7:
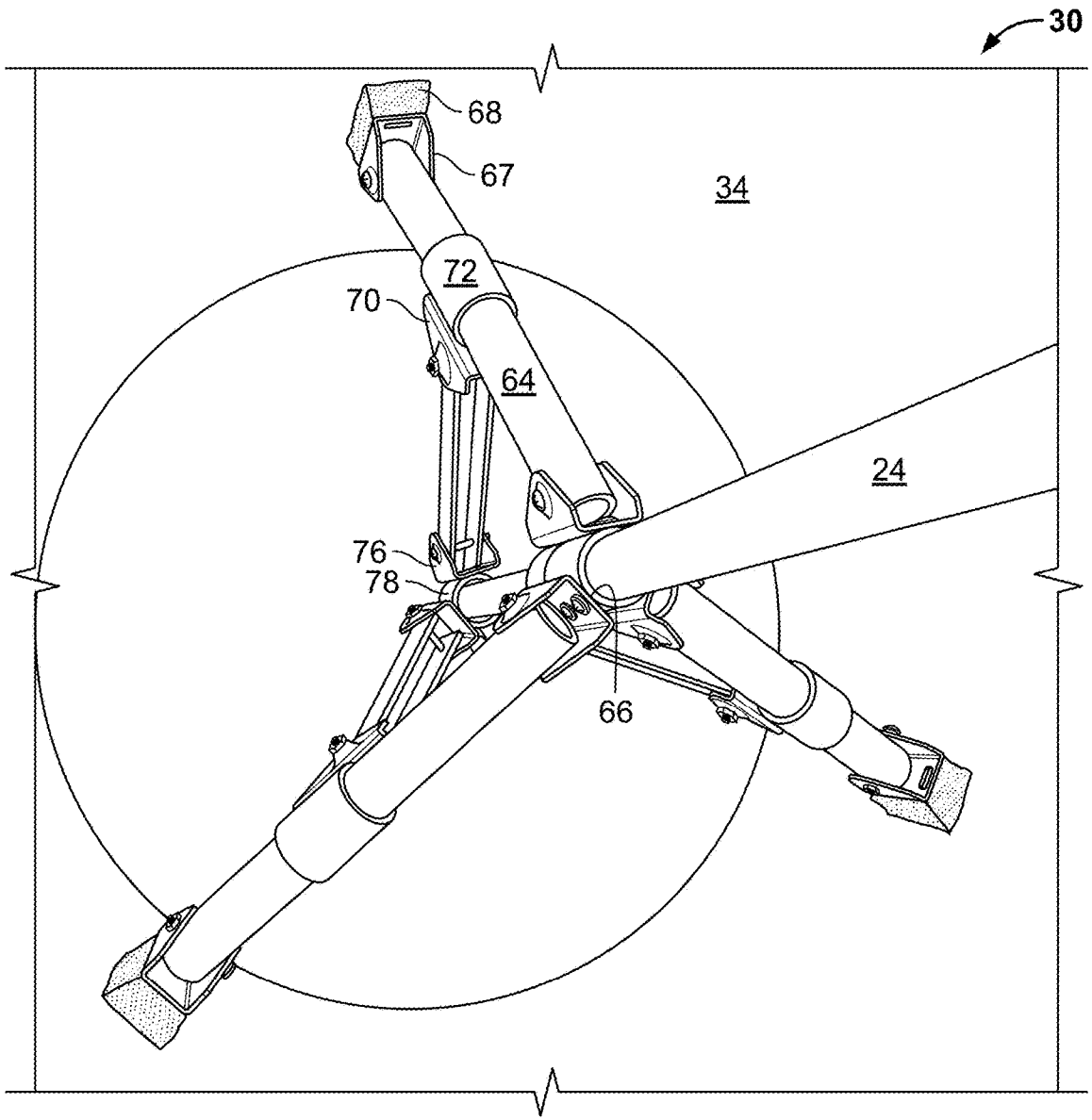
FIG. 7 illustrates a second view of adjustable stabilizing legs of the epoxy coating apparatus.

Referring to FIGS. 6 and 7, a first and second view of adjustable stabilizing legs of the epoxy coating apparatus are shown.

The adjustable legs 60 include primary hinges 62 between the primary arms 64 and the primary sliding coupling 66 that moves along the drive axle 24.

Each primary arm 64 ends in a foot 68 connected by a foot hinge 67.

Secondary hinges 70 connect each secondary sliding coupling 72 with its connecting arm 74. Tertiary hinges 76 connect each connecting arm 74 with the fixed coupling 78, which is set in position on the drive axle 24.

The movement of primary sliding coupling 66 along the drive axle 24 moves the feet 68 toward and away from the drive axle 24, allowing the adjustable legs 60 to grip the inner surface 34 of cylindrical items 30 of differing sizes.

Figure 8:
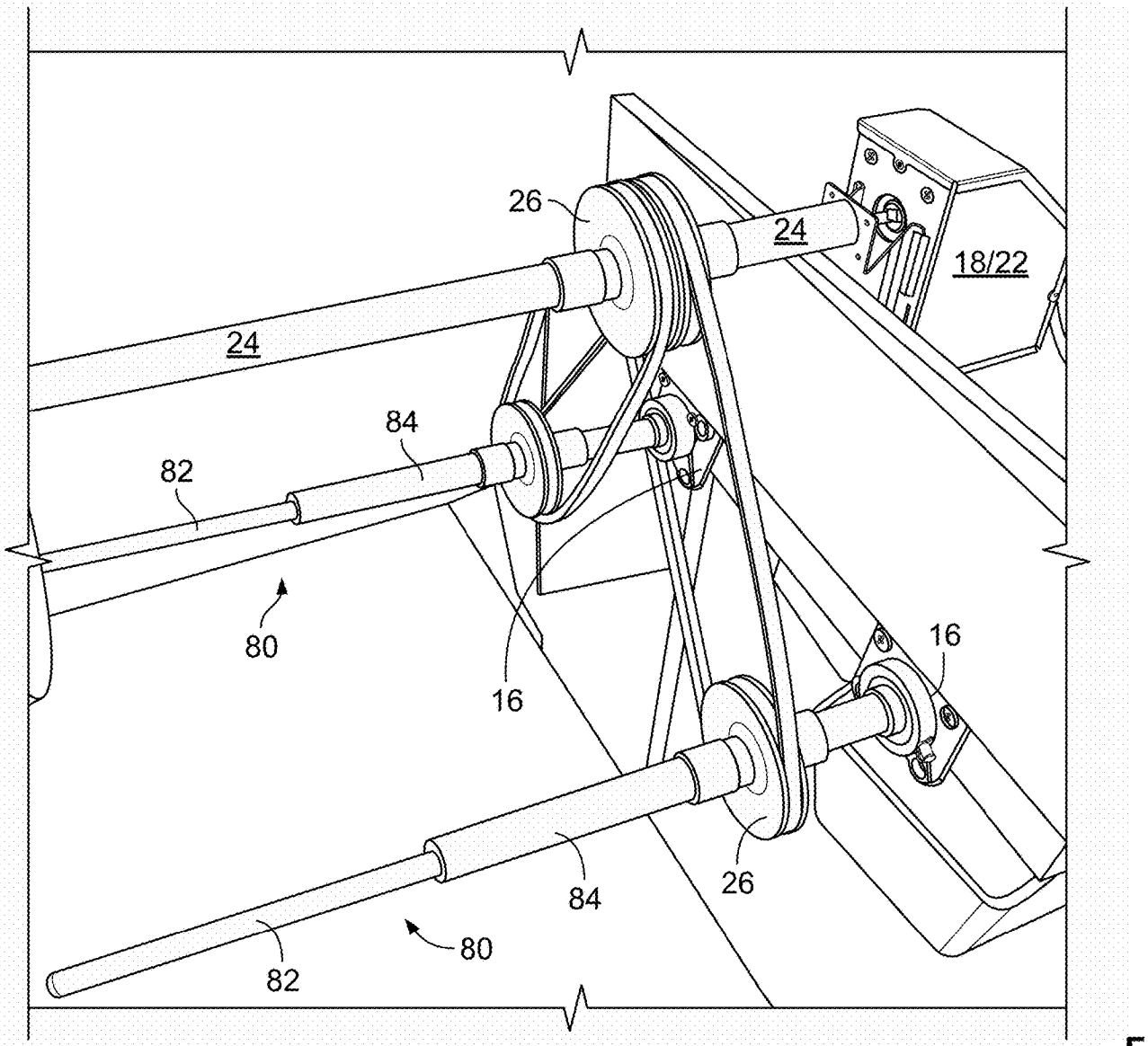
FIG. 8 illustrates a third view of the epoxy coating apparatus.

Referring to FIG. 8, a third view of the epoxy coating apparatus is shown.

The motor 18 and gearbox 22 are shown connected to the drive axle 24, which is in turn connected with pulleys 26 and belts 28 to locations of secondary item rotation 80, which are supported by bearings 16. Shown here as secondary items are drumsticks 82 inserted into chucks 84.

Figure 9:
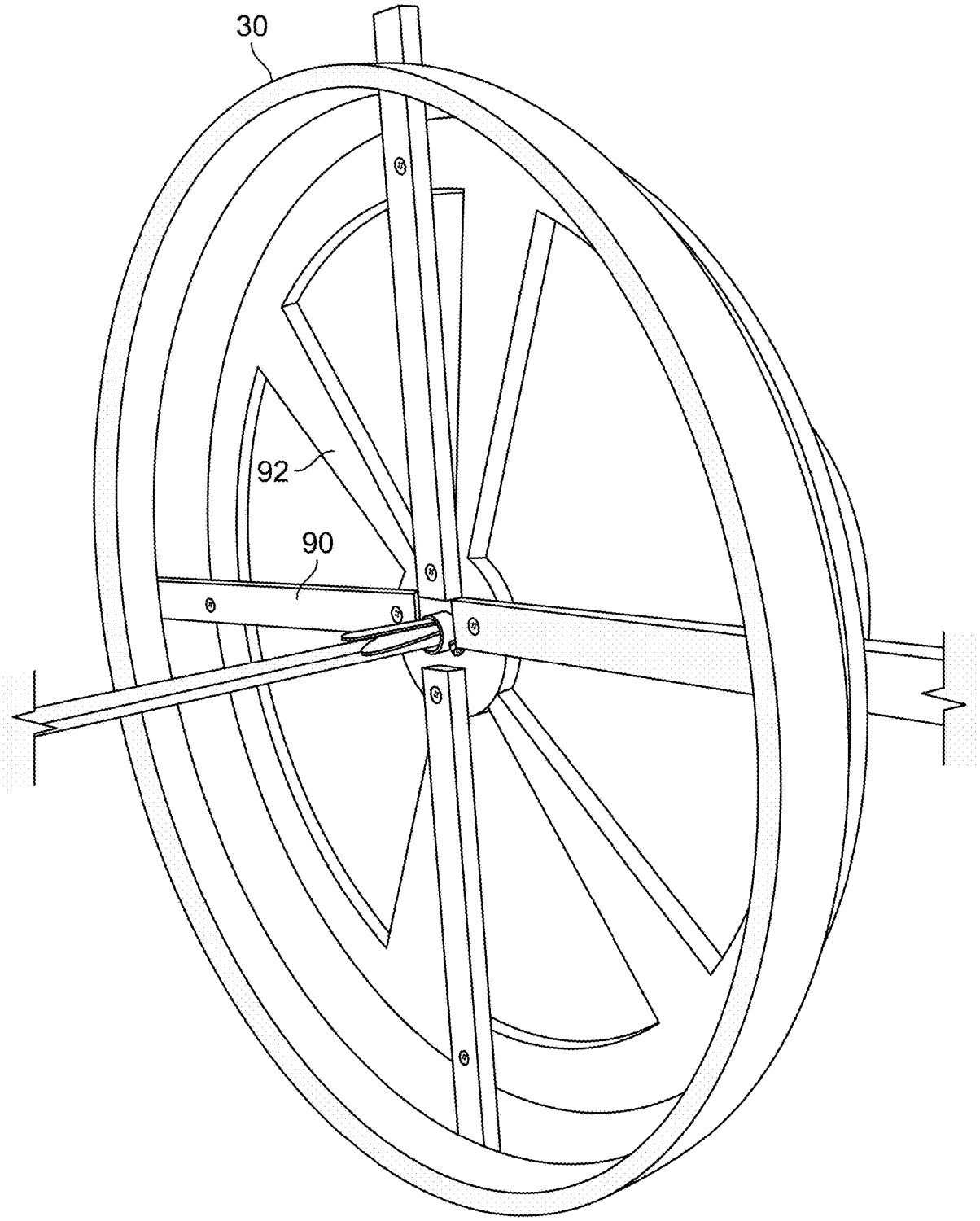
FIG. 9 illustrates a view of a stabilizing mount for shallow objects to be coated using the epoxy coating apparatus.

Referring to FIG. 9, a view of a stabilizing mount for shallow objects to be coated using the epoxy coating apparatus is shown.

When the cylindrical item 30 is shallow, it may be affixed to a support arms 90 held using spoked support 92.

Figure 10B:
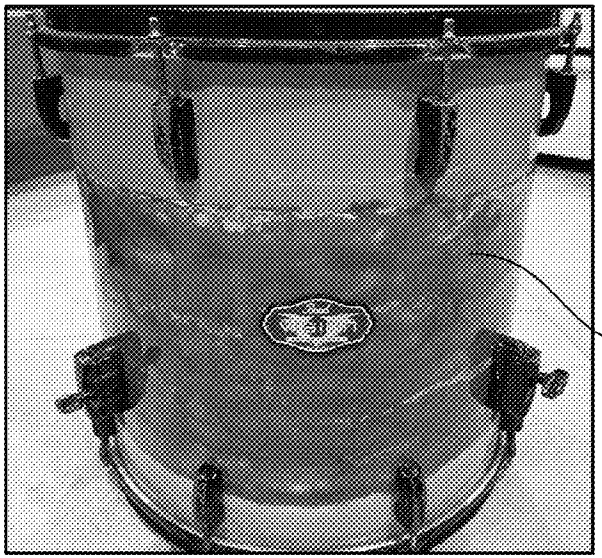
FIG. 10B illustrates a drum after coating of the epoxy coating apparatus.
Figure 10B:
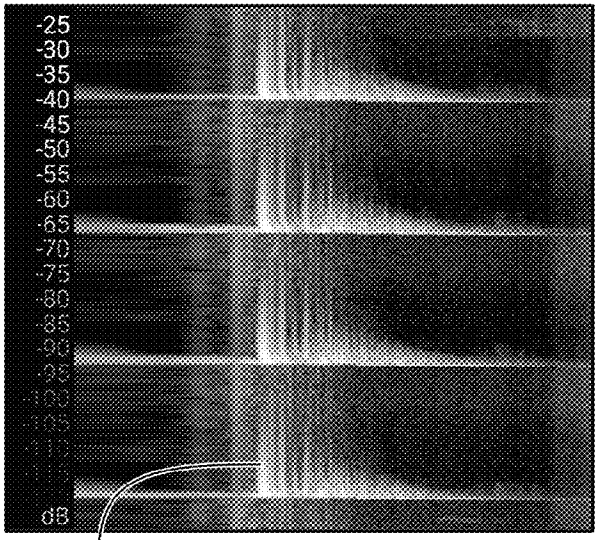
Figure 10A:
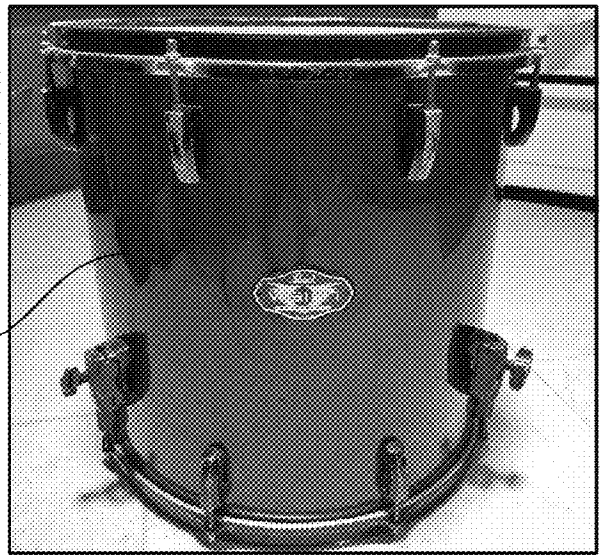
FIG. 10A illustrates a drum before coating of the epoxy coating apparatus.
Figure 10A:
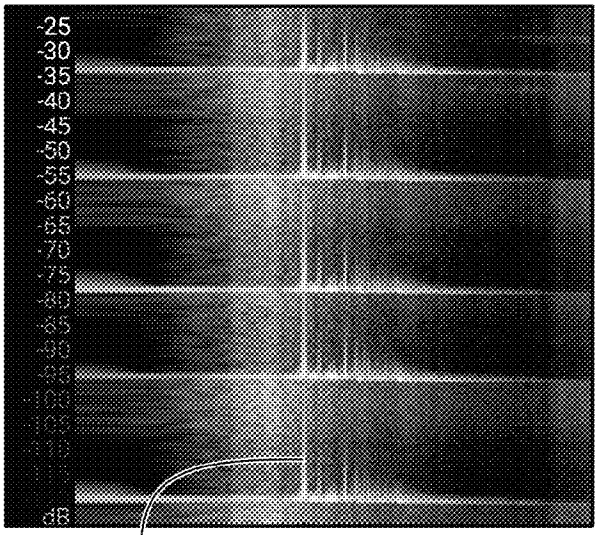

Referring to FIG. 10A, a drum without the epoxy coating. Referring to FIG. 10B, a drum after coating of the epoxy coating apparatus is shown.

The uncoated drum 200 is a traditional vinyl-wrapped drum. Below the uncoated drum 200 is a decibel chart of the sound produced when the drum is struck. The drum is struck at moment 210, with the sound that follows being the drum head and shell resonating.

The coating drum 202 is the same drum, but with the vinyl wrap removed and the epoxy coating applied as described herein. The drum is struck at moment 210. The resonance shown in the chart indicates a truer and stronger note and tone. This effect occurs because the epoxy coating reduces the tendency of the plywood shell of the drum to vibrate, instead increasing the resonance between the upper and lower head of the drum. The result is a stronger, truer, deeper and longer-lasting note that is noticeable to the ear.

Figure 11A:
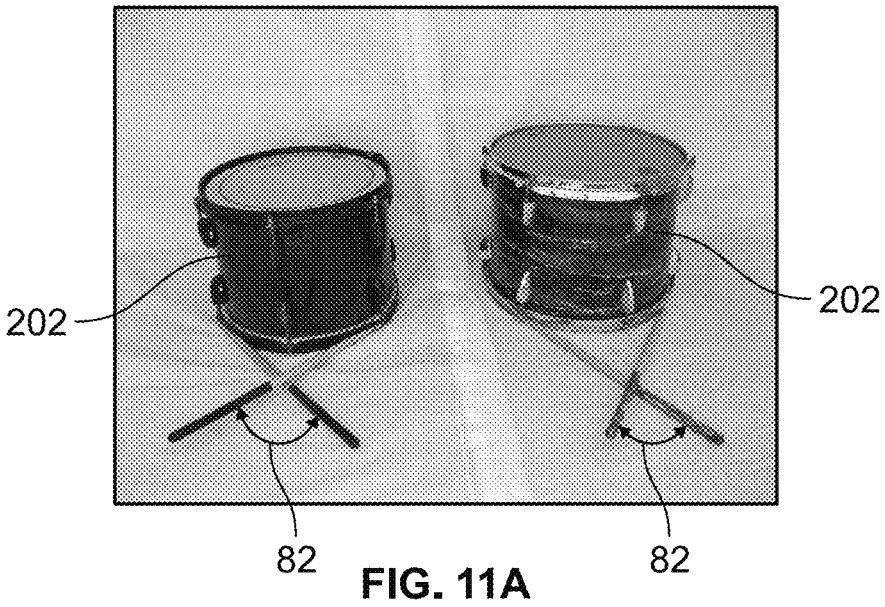
FIG. 11A illustrates a first set of coated objects of the epoxy coating apparatus.

Referring to FIG. 11A, a first set of coated objects of the epoxy coating apparatus is shown.

Coating drums 202 and drumsticks 82 are shown.

Figure 11B:
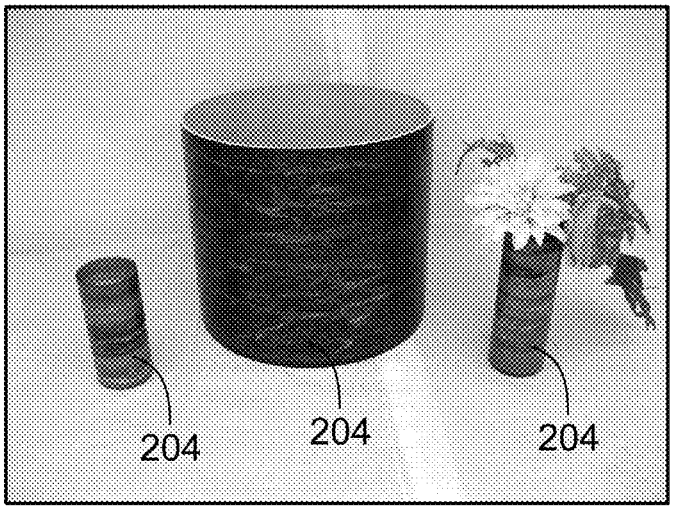
FIG. 11B illustrates a second set of coated objects of the epoxy coating apparatus.
Figure 11C:
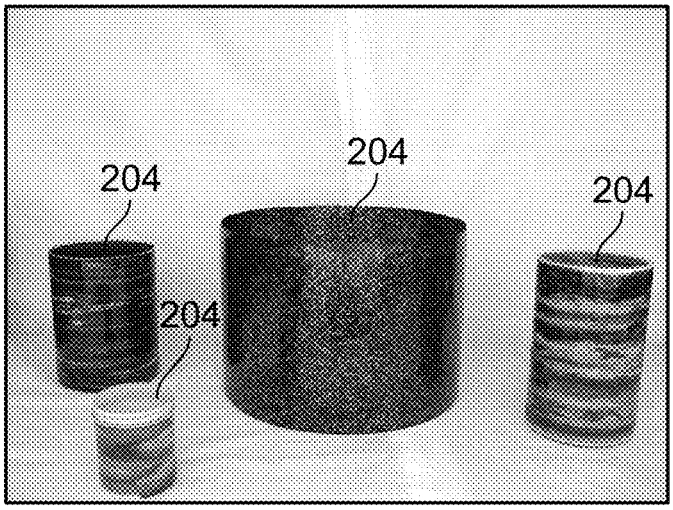
FIG. 11C illustrates a third set of coated objects of the epoxy coating apparatus.

Referring to FIGS. 11B and C, a second and third set of coated objects of the epoxy coating apparatus are shown.

The artistry associated with the use of the disclosed method is evident.

While the beauty of the resulting item will vary depending on the skill of the user, the protective quality is consistent.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method for epoxy-coating a cylindrical object, the cylindrical object including an outer surface and an inner surface, the method comprising the steps of:

mounting the cylindrical object on an epoxy coating apparatus, the epoxy coating apparatus including:
- an axle supported at one or more ends;
- a motor mechanically connected the axle, the motor able to rotate the axle;
- an internal support affixed to the axle, the internal support bridging a space between the axle and the inner surface of the cylindrical item;

applying a sealing coat of epoxy mixture to the outer surface of the cylindrical object;
- allowing the sealing coat to cure;
- sanding the sealing coat to smooth the surface;

creating layers of epoxy by:
- mixing an epoxy resin and an epoxy hardener to form an epoxy mixture;
- starting rotation of the cylindrical object using the epoxy coating apparatus;
- applying the epoxy mixture to the outer surface of the cylindrical item;
- manipulating the epoxy mixture on the outer surface to create desired effects;
- rotating the cylindrical item until the epoxy mixture has set;

repeating the "creating layers" sub-steps for each additional layer;

continuing to rotate the cylindrical object until all created layers of epoxy have set; and applying a sealing coat of epoxy over the epoxy layers;

whereby the result is a cylindrical item with improved acoustic characteristics and a unique appearance; and wherein the internal support is comprised of:
- adjustable legs including:
  - three or more primary hinges connecting three or more primary arms at a single primary sliding coupling;
    - the single primary sliding coupling sliding along the axle;
    - each of the three or more primary arms ending at a foot;
  - three or more secondary hinges connecting each of the three or more secondary sliding couplings to its respective connecting arm;
    - the secondary sliding couplings able to move along their respective primary arm of the three of more primary arms;
  - three or more tertiary hinges connecting their respective connecting arms to the axle at a fixed coupling;
    - the fixed coupling adjustable along the axle, but able to be temporarily fixed in position;
  - whereby movement of primary sliding coupling along the axle moves the feet toward and away from the axle, thus allowing the adjustable legs to grip the inner surface of cylindrical items of differing sizes.

2. The method of claim 1, wherein the sub-step of "manipulating the epoxy mixture on the outer surface to create desired effects" includes application of force to the epoxy mixture using a heat gun.

3. The method of claim 1, wherein the sub-step of "manipulating the epoxy mixture on the outer surface to create desired effects" includes application of force to the epoxy mixture using a gloved hand.

4. The method of claim 1, wherein the epoxy coating apparatus further includes a speed control that controls rotational speed of the motor.

5. The method of claim 1, wherein the epoxy coating apparatus further includes a directional control that controls direction of rotation of the motor.

6. The method of claim 5, wherein the directional control reverses the direction of rotation of the motor following a set number of rotations in a given direction.

7. The method of claim 1, wherein the epoxy coating apparatus further includes:

secondary object rotation for parallel rotation of an additional cylindrical object, such as a drumstick;

the secondary object rotation including an additional axle that is rotationally connected to the axle.

8. The method of claim 1, wherein the internal support is comprised of:

an air bladder, the air bladder including an end surface and a perimeter surface;

the perimeter surface in contact with the inner surface of the cylindrical object during use of the epoxy coating apparatus;

the end surface connecting the perimeter surface to the axle of the epoxy coating apparatus;

the air bladder able to be inflated and deflated for use with cylindrical object of differing sizes.

9. A method of coating a cylindrical object with epoxy comprising the steps of:

mounting the cylindrical object on an apparatus, the apparatus able to continually and consistently rotate the cylindrical object about a center point;

the cylindrical object including an outer surface and an inner surface;

activating the apparatus, thus beginning rotation of the cylindrical object;

choosing a type of epoxy for application to the outer surface, the epoxy formed from an epoxy resin and an epoxy hardener;

mixing the epoxy resin and hardener at a desired ratio to create an epoxy mixture;

applying the epoxy mixture to the outer surface of the cylindrical object, fully or partially coating the outer surface;

manipulating the epoxy mixture to create artistic effects;

continuing rotation of the cylindrical object until the epoxy mixture has thickened and is no longer readily manipulated;

if desired, repeating the steps of mixing, applying, manipulating, and continuing rotation for any additional layers of epoxy; and continuing additional rotation of the cylindrical object until the epoxy mixture(s) have fully cured;

whereby the cylindrical object is coated in epoxy, providing strength and a pleasing appearance; and wherein the apparatus uses an internal support for physical connection to the cylindrical object, the internal support comprised of:

adjustable legs including:

three or more primary hinges connecting three or more primary arms at a single primary sliding coupling;

the single primary sliding coupling sliding along an axle;

each of the three or more primary arms ending at a foot;

three or more secondary hinges connecting each of the three or more secondary sliding couplings to its respective connecting arm;

the secondary sliding couplings able to move along their respective primary arm of the three of more primary arms;

three or more tertiary hinges connecting their respective connecting arms to the axle at a fixed coupling;

the fixed coupling adjustable along the axle, but able to be temporarily fixed in position;

whereby movement of primary sliding coupling along the axle moves the feet toward and away from the axle, thus allowing the adjustable legs to grip the inner surface of cylindrical items of differing sizes.

10. The method of claim 9, wherein the step of "manipulating" includes application of force to the epoxy mixture using a heat gun.

11. The method of claim 9, wherein the step of "manipulating" includes application of force to the epoxy mixture using an object such as a gloved hand.

12. The method of claim 9, wherein the apparatus further includes a speed control that controls rotational speed of a motor, the motor causing rotation of the cylindrical item.

13. The method of claim 9, wherein the apparatus further includes a directional control that controls direction of rotation of the motor.

14. The method of claim 13, wherein the directional control reverses the direction of rotation of the motor follow a set number of rotations in a given direction.

15. The method of claim 9, wherein the apparatus further includes:

secondary object rotation for rotation of an additional cylindrical object, such as a drumstick.

16. The method of claim 9, wherein the apparatus uses an internal support for physical connection to the cylindrical object, the internal support comprised of:

an air bladder, the air bladder including an end surface and a perimeter surface;

the perimeter surface in contact with the inner surface of the cylindrical item during use of the apparatus;

the end surface connecting the perimeter surface to an axle of the apparatus;

the air bladder able to be inflated and deflated for use with cylindrical items of differing sizes.

* * * * *